US007730818B1

(12) United States Patent
Kannegieter

(10) Patent No.: US 7,730,818 B1
(45) Date of Patent: Jun. 8, 2010

(54) FOOD SLICING SYSTEM

(76) Inventor: Kent H. Kannegieter, 10086 Haley's Hollow Ct., Glen Allen, VA (US) 23060

( * ) Notice: Subject to any disclaimer, the term of this patent is extended or adjusted under 35 U.S.C. 154(b) by 226 days.

(21) Appl. No.: 11/734,778

(22) Filed: Apr. 12, 2007

(51) Int. Cl.
*B26D 5/08* (2006.01)

(52) U.S. Cl. ..... 83/597; 83/599; 83/466.1; 83/932; 30/114; 30/301; 30/304

(58) Field of Classification Search ..... 83/599, 83/651.1, 655, 657, 466.1, 932, 597, 598; 30/114, 116, 117, 299, 301, 304; 99/537, 99/552, 553, 557, 564
See application file for complete search history.

(56) References Cited

U.S. PATENT DOCUMENTS

| | | | | | |
|---|---|---|---|---|---|
| 1,183,472 | A * | 5/1916 | Lewandowski | 83/607 |
| 1,598,404 | A | 8/1926 | Tally | |
| 1,621,956 | A * | 3/1927 | Schmand | 83/599 |
| D85,385 | S * | 10/1931 | Lowitz | D7/673 |
| 2,089,258 | A * | 8/1937 | Hamad | 83/599 |
| 2,405,385 | A * | 8/1946 | Wingate | 83/466.1 |
| 2,592,657 | A * | 4/1952 | Cierley | 83/543 |
| 2,716,814 | A | 9/1955 | Lerner | |
| 2,991,813 | A * | 7/1961 | Wilms | 99/494 |
| 3,561,511 | A * | 2/1971 | Kummer | 83/597 |
| 4,383,365 | A | 5/1983 | Metzigian | |
| D308,803 | S | 6/1990 | Horton et al. | |
| 5,499,578 | A | 3/1996 | Payne | |
| 5,799,401 | A * | 9/1998 | Gering | 30/300 |
| 6,558,244 | B1 * | 5/2003 | Nedelka | 452/149 |
| 2004/0025651 | A1 | 2/2004 | Bachman et al. | |

* cited by examiner

*Primary Examiner*—Boyer D Ashley
*Assistant Examiner*—Omar Flores-Sánchez

(57) ABSTRACT

A food slicing system for slicing a food article into a plurality of pieces of equal thickness includes a base having a front wall, a rear wall and a pair of end walls extending between the front and rear walls. A catch aperture is defined by the front wall, the rear wall and the end walls. The front wall, the rear wall and the end walls extend upwardly from a bottom face. A cutting assembly is hingedly coupled to the base. The cutting assembly is pivoted towards the base to slice food articles on the base into a plurality of slices.

11 Claims, 4 Drawing Sheets

FOOD SLICING SYSTEM

BACKGROUND OF THE INVENTION

1. Field of the Invention

The present invention relates to food cutters and more particularly pertains to a new food cutter for slicing a food article simultaneously into a plurality of pieces of equal thickness.

2. Description of the Prior Art

The use of food cutters is known in the prior art. While these devices fulfill their respective, particular objectives and requirements, the need remains for a system that has certain improved features to allow an adjustment of the system to allow a food article to be sliced into plurality of slices of a desired thickness. Additionally, the system should engage the food article to maintain positioning of the food article during slicing of the food article.

SUMMARY OF THE INVENTION

The present invention meets the needs presented above by generally comprising a base including a front wall, a rear wall and a pair of end walls extending between the front and rear walls. A catch aperture is defined by the front wall, the rear wall and the end walls. The front wall, the rear wall and the end walls extend upwardly from a bottom face. A cutting assembly is hingedly coupled to the base. The cutting assembly is pivoted towards the base to slice food articles on the base into a plurality of slices.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
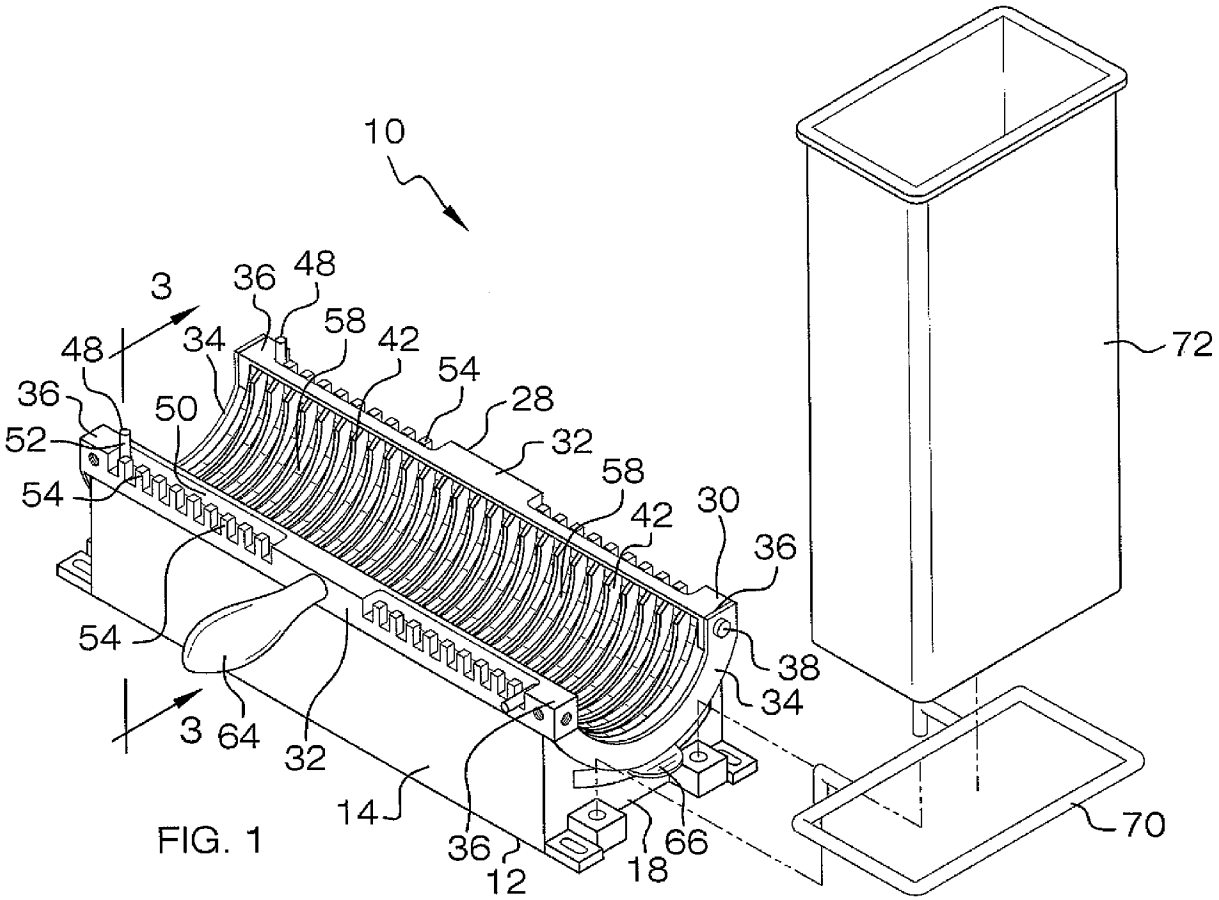
FIG. 1 is an exploded perspective view of a food slicing system according to the present invention.
Figure 2:
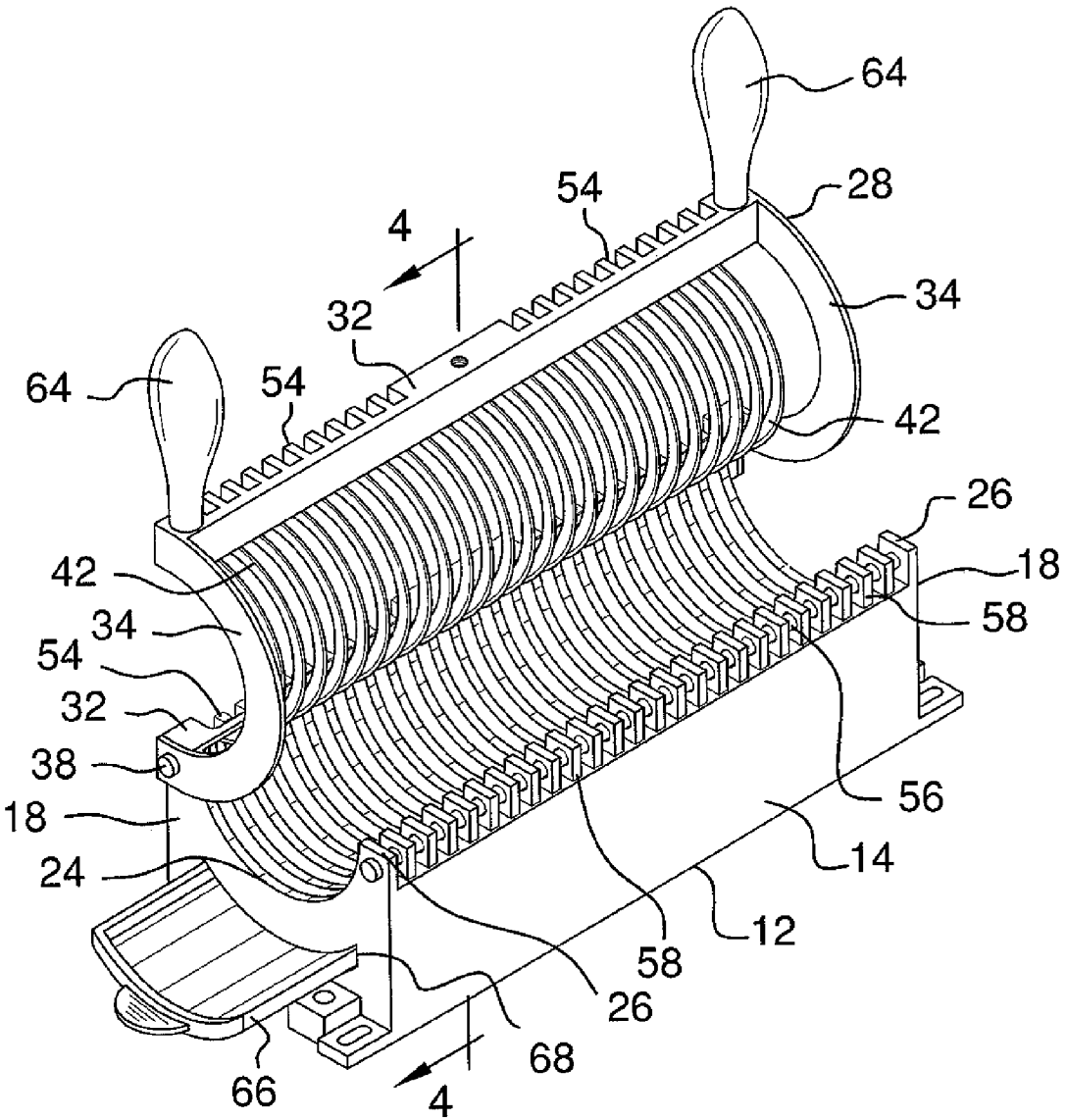
FIG. 2 is a perspective view of the present invention showing the frame and blades pivoted away from the base.
Figure 4:
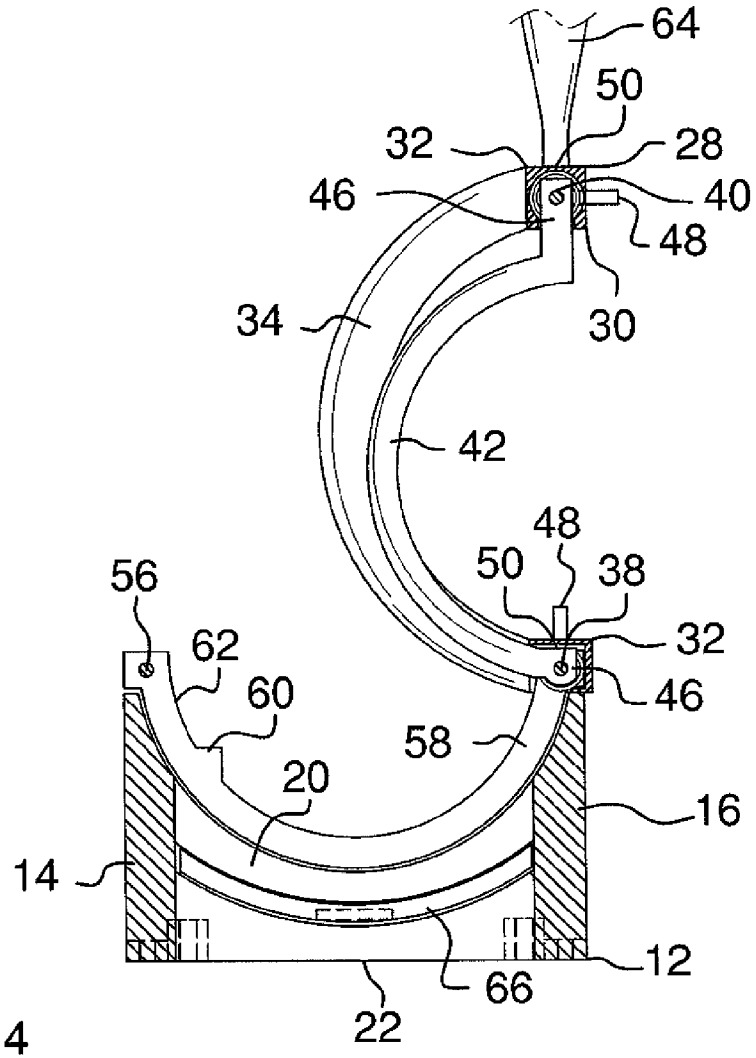
FIG. 4 is a cross-sectional view of the present invention taken along line 4-4 of FIG. 2.
Figure 3:
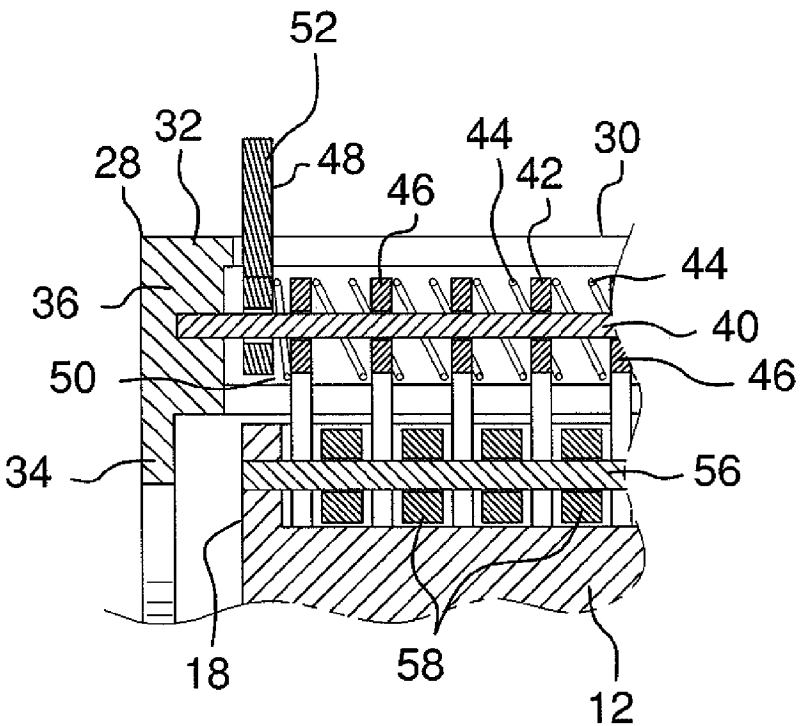
FIG. 3 is a cross-sectional view of the present invention taken along 3-3 of FIG. 1.
Figure 5:
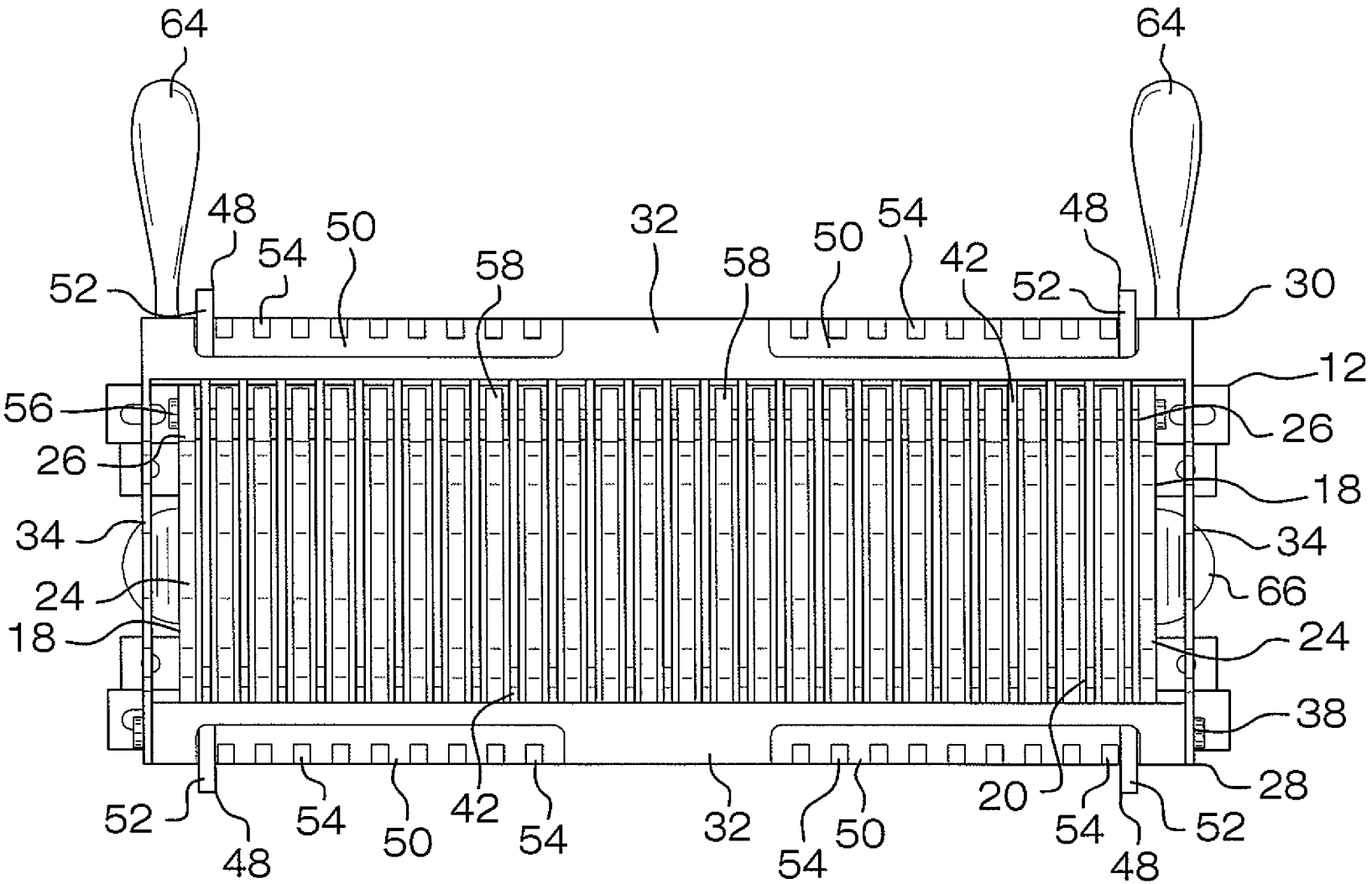
FIG. 5 is a top view of the present invention.

With reference now to the drawings, and in particular to FIGS. 1 through 5 thereof, a new food cutter embodying the principles and concepts of the present invention and generally designated by the reference numeral 10 will be described.

As best illustrated in FIGS. 1 through 5, the food slicing system 10 generally comprises a base 12 including a front wall 14, a rear wall 16 and a pair of end walls 18 extending between the front 14 and rear 16 walls. A catch aperture 20 is defined by the front wall 14, the rear wall 16 and the end walls 18. The base 12 includes a bottom face 22. The front wall 14, the rear wall 16 and the end walls 18 extending upwardly therefrom. Each of the end walls 18 has an arcuate cutout 24 extending into the associated one of the end walls 18 through a top edge 26 thereof.

A cutting assembly 28 is hingedly coupled to the base 12. The cutting assembly 28 is pivoted towards the base 12 to slice food articles on the base 12 into a plurality of slices. The cutting assembly 28 includes a frame 30 hingedly coupled to the base 12. The frame 30 includes a pair of side bars 32 and a pair of end rails 34. One of a pair of terminal ends 36 of each of the side bars 32 has one of the end rails 34 coupled thereto. The end rails 34 maintain positioning of the side bars 32 with respect to each other. One of the side bars 32 is pivotally coupled to the rear wall 16. A first rod 38 extends through one of the side bars 32 and a portion of the base 12, wherein the cutting assembly 28 is pivoted around the first rod 38. The first rod 38 extends along the rear wall 16.

The cutting assembly 28 also includes a second rod 40 coupled to and extending through the one of the side bars 32 not containing the first rod 38. Each of a plurality of blades 42 is slidably mounted to the first 38 and second 40 rods. Each of the blades 42 slices the food articles positioned on the base 12 when the cutting assembly 28 is pivoted towards the base 12. Each of the blades 42 is arcuate and extends downwardly from the side bars 32. Each of the first 38 and second 40 rods has a plurality of biasing members 44 slidably mounted thereon. A mounted end 46 of each of the blades 42 is positioned between an adjacently positioned pair of the biasing members 44. The biasing members 44 bias the blades 42 apart to maintain a substantially even spacing between the blades 42.

The cutting assembly 28 also includes a plurality of adjustment guides 48. Each of the first 38 and second 40 rods has a pair of the adjustment guides 48 slidably mounted thereon. Each of the adjustment guides 48 is positioned in one of a pair of channels 50 of an associated one of the side bars 32. Each of the adjustment guides 48 is positioned adjacent one of the ends rails 34 of the frame 30. One of the biasing members 44 is positioned between each of the adjustment guides 48 and an adjacently positioned one of the blades 42, wherein adjustment of the adjustment guides 48 along the associated one of the channels 50 changes a distance between the blades 42.

Each of the adjustment guides 48 includes a locking arm 52 extending upwardly from the associated one of the channels 50. The locking arm 52 is pivoted downwardly to abut one of a plurality of locking tabs 54 positioned in the associated one of the channels 50 to secure the associated one of the adjustment guides 48 in the desired position. The adjustment guides 48 on either the first rod 38 or the second rod 40 may be slid to adjust the blades 42 on one end to allow the blades 42 to extend at an angle from the first rod 38 to the second rod 40.

The cutting assembly 28 additionally includes a third rod 56 coupled to the base 12. The third rod 56 is positioned across the catch aperture 20 from the first rod 38. The third rod 56 extends along the front wall 14. Each of a plurality of spacers 58 is slidably mounted to and extends between the first 38 and third 56 rods. Each of the spacers 58 is positioned between the end walls 18 of the base 12. Each of the spacers 58 is positioned between adjacently positioned pairs of the blades 42.

Each of the spacers 58 is shaped to approximately match the shape of the blades 42. Each of the spacers 58 engages the food articles and supports the food articles when the blades 42 are slicing the food article. Spacing between each of the spacers 58 is adjusted when the spacing between the blades 42 is adjusted.

Each of the spacers 58 includes a tooth 60 outwardly extending from an interior face 62 thereof, wherein the tooth 60 pierces the food articles to maintain positioning of the food articles during slicing. At least one handle 64 is couplable to the frame 30. The handle 64 is graspable to facilitate pivoting of the frame 30 with respect to the base 12.

A tray 66 is inserted into a slot 68 extending through each of the end walls 18 of the base 12. The tray 66 is in communication with the catch aperture 20 to receive debris from the food article being sliced. The tray 66 is removable from the base 12 through one of the end walls 18 to discard the collected debris. A support 70 is mountable to one of the end walls 18 of the base 12. The support 70 extends outwardly from the base 12 when mounted to the base 12. A basket 72 is insertable into the support 70. The basket 72 receives the sliced food articles.

In use, the locking arm 52 of each of the adjustment guides 48 is pivoted upwardly and the adjustment guides 48 are slid along the channels 50 to adjust the spacing between the blades 42 and the spacers 58 to slice the food articles into slices of the desired thickness. The locking arm 52 is then pivoted downwardly to secure the blades 42 and the spacers 58 in the desired configuration. The food article is placed on the spacers 58 and the blades 42 are pivoted down onto the food article to slice the food article. The slices of the food article are then deposited into the basket 72.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A food slicing system for slicing food articles, said system comprising:

a base including a front wall, a rear wall and a pair of end walls extending between said front and rear walls, a catch aperture being defined by said front wall, said rear wall and said end walls, said front wall, said rear wall and said end walls extending upwardly from a bottom face; and a cutting assembly being hingedly coupled to said base, said cutting assembly being pivoted towards said base to slice food articles on said base into a plurality of slices said cutting assembly including;

a frame being hingedly coupled to said base, said frame including a pair of side bars and a pair of end rails, one of a pair of terminal ends of each of said side bars having one of said end rails coupled thereto, said end rails maintaining positioning of said side bars with respect to each other;

a first rod extending through one of said side bars and a portion of said base, wherein said cutting assembly is pivoted around said first rod;

a second rod being coupled to and extending through the one of said side bars not containing said first rod;

a plurality of blades being slidably mounted to said first and second rods, each of said blades slicing the food articles positioned on said base when said cutting assembly is pivoted towards said base;

a plurality of biasing members, each of said first and second rods having a plurality of said biasing members slidably mounted thereon, a mounted end of each of said blades being positioned between an adjacently positioned pair of said biasing members, said biasing members biasing said blades apart to maintain a substantially even spacing between said blades;

a plurality of adjustment guides, each of said first and second rods having a pair of said adjustment guides slidably mounted thereon, each of said adjustment guides being positioned adjacent one of said ends rails of said frame, each of said adjustment guides being positioned in one of a pair of channels of an associated one of said side bars, one of said biasing members being positioned between each of said adjustment guides and an adjacently positioned one of said blades, wherein adjustment of said adjustment guides along the associated one of said channels changes a distance between said blades, each of said adjustment guides including a locking arm extending upwardly from the associated one of said channels, said locking arm being pivoted downwardly to abut one of a plurality of locking tabs positioned in the associated one of said channels to secure the associated one of said adjustment guides in the desired position.

2. The system according to claim 1, wherein each of said end walls has an arcuate cutout extending into the associated one of said end walls through a top edge thereof.

3. The system according to claim 1, wherein one of said side bars is pivotally coupled to said rear wall.

4. The system according to claim 1, wherein each of said blades is arcuate and extending downwardly from said side bars.

5. The system according to claim 1, wherein said cutting assembly includes a third rod being coupled to said base, said third rod being positioned across said catch aperture from said first rod.

6. The system according to claim 5, wherein said cutting assembly includes a plurality of spacers, each of said spacers being slidably mounted to and extending between said first and third rods, each of said spacers being positioned between said end walls of said base, each of said spacers being positioned between adjacently positioned pairs of said blades, each of said spacers engaging the food articles and supporting the food articles when said blades are slicing the food article, spacing between each of said spacers being adjusted when the spacing between said blades is adjusted.

7. The system according to claim 6, wherein each of said spacers includes a tooth outwardly extending from an interior face thereof, wherein said tooth pierces the food articles to maintain positioning of the food articles during slicing.

8. The system according to claim 1, said cutting assembly includes at least one handle being couplable to said frame, said handle being graspable to facilitate pivoting of said frame with respect to said base.

9. The system according to claim 1, further including a tray being inserted into a slot extending through each of said end walls of said base, said tray being in communication with said catch aperture to receive debris from the food article being sliced, said tray being removable from said base through one of said end walls to discard the collected debris.

10. The system according to claim 1, further including a support being mountable to one of said end walls of said base, said support extending outwardly from said base when mounted to said base; and a basket being insertable into said support, said basket receiving the sliced food articles.

11. A food slicing system for slicing food articles, said system comprising:

a base including a front wall, a rear wall and a pair of end walls extending between said front and rear walls, a catch aperture being defined by said front wall, said rear wall and said end walls, said base including a bottom face, said front wall, said rear wall and said end walls extending upwardly therefrom, each of said end walls having an arcuate cutout extending into the associated one of said end walls through a top edge thereof;

a cutting assembly being hingedly coupled to said base, said cutting assembly being pivoted towards said base assembly to slice food articles on said base into a plurality of slices, said cutting assembly comprising;

a frame being hingedly coupled to said base, said frame including a pair of side bars and a pair of end rails, one of a pair of terminal ends of each of said side bars having one of said end rails coupled thereto, said end rails maintaining positioning of said side bars with respect to each other, one of said side bars being pivotally coupled to said rear wall;

a first rod extending through one of said side bars and a portion of said base, wherein said cutting assembly is pivoted around said first rod, said first rod extending along said rear wall;

a second rod being coupled to and extending through the one of said side bars not containing said first rod;

a plurality of blades being slidably mounted to said first and second rods, each of said blades slicing the food articles positioned on said base when said cutting assembly is pivoted towards said base, each of said blades being arcuate and extending downwardly from said side bars;

a plurality of biasing members, each of said first and second rods having a plurality of said biasing members slidably mounted thereon, a mounted end of each of said blades being positioned between an adjacently positioned pair of said biasing members, said biasing members biasing said blades apart to maintain a substantially even spacing between said blades;

a plurality of adjustment guides, each of said first and second rods having a pair of said adjustment guides slidably mounted thereon, each of said adjustment guides being positioned in one of a pair of channels of an associated one of said side bars, each of said adjustment guides being positioned adjacent one of said ends rails of said frame, one of said biasing members being positioned between each of said adjustment guides and an adjacently positioned one of said blades, wherein adjustment of said adjustment guides along the associated one of said channels changes a distance between said blades, each of said adjustment guides including a locking arm extending upwardly from the associated one of said channels, said locking arm being pivoted downwardly to abut one of a plurality of locking tabs positioned in the associated one of said channels to secure the associated one of said adjustment guides in the desired position;

a third rod being coupled to said base, said third rod being positioned across said catch aperture from said first rod, said third rod extending along said front wall;

a plurality of spacers, each of said spacers being slidably mounted to and extending between said first and third rods, each of said spacers being positioned between said end walls of said base, each of said spacers being positioned between adjacently positioned pairs of said blades, each of said spacers being shaped to approximately match the shape of said blades, each of said spacers engaging the food articles and supporting the food articles when said blades are slicing the food article, spacing between each of said spacers being adjusted when the spacing between said blades is adjusted, each of said spacers including a tooth outwardly extending from an interior face thereof, wherein said tooth pierces the food articles to maintain positioning of the food articles during slicing; and at least one handle being couplable to said frame, said handle being graspable to facilitate pivoting of said frame with respect to said base.

* * * * *